US008357061B2

(12) United States Patent
Quinn

(10) Patent No.: US 8,357,061 B2
(45) Date of Patent: Jan. 22, 2013

(54) TRAINING APPARATUS

(76) Inventor: Patrick Joseph Quinn, Markham (CA)

( * ) Notice: Subject to any disclaimer, the term of this patent is extended or adjusted under 35 U.S.C. 154(b) by 0 days.

(21) Appl. No.: 12/895,038

(22) Filed: Sep. 30, 2010

(65) Prior Publication Data

US 2012/0083367 A1 Apr. 5, 2012

(51) Int. Cl.
*A63B 69/00* (2006.01)

(52) U.S. Cl. ..... 473/446; 473/422

(58) Field of Classification Search ..... 473/422, 473/446, 438, 471, 476, 477; 482/50–54
See application file for complete search history.

(56) References Cited

U.S. PATENT DOCUMENTS

| | | | | | |
|---|---|---|---|---|---|
| 2,354,050 | A | * | 7/1944 | Paupa | 473/440 |
| 3,955,815 | A | * | 5/1976 | Deschesnes | 473/446 |
| 4,070,017 | A | * | 1/1978 | Toronto | 473/446 |
| 4,607,842 | A | * | 8/1986 | Daoust | 473/446 |
| 5,161,799 | A | * | 11/1992 | Nandra | 473/446 |
| 5,226,821 | A | | 7/1993 | Murphy et al. | |
| 5,362,045 | A | | 11/1994 | Hammett et al. | |
| 5,620,404 | A | * | 4/1997 | Eyman | 482/142 |
| 5,769,742 | A | * | 6/1998 | Bristow | 473/446 |
| 5,807,185 | A | * | 9/1998 | Raubuck et al. | 473/229 |
| 6,012,994 | A | * | 1/2000 | Beluse | 473/446 |
| 6,090,015 | A | * | 7/2000 | Meyers | 482/54 |
| 6,099,420 | A | * | 8/2000 | Nandra | 473/446 |
| 6,132,338 | A | * | 10/2000 | Shifferaw | 482/30 |
| 6,165,084 | A | * | 12/2000 | Cranston | 473/422 |
| 6,921,339 | B1 | * | 7/2005 | Martin et al. | 472/89 |
| 6,926,624 | B1 | | 8/2005 | Witzke | |
| 6,926,643 | B1 | * | 8/2005 | Gvoich | 482/52 |
| 7,850,576 | B2 | * | 12/2010 | Sellke | 482/51 |
| 7,905,800 | B2 | * | 3/2011 | Oneschuk | 473/446 |
| 2006/0063615 | A1 | * | 3/2006 | Richardson et al. | 473/446 |
| 2008/0287224 | A1 | * | 11/2008 | Salvador et al. | 473/446 |

FOREIGN PATENT DOCUMENTS

| | | | |
|---|---|---|---|
| CA | 1305731 | A | 7/1992 |
| CA | 2339869 | A1 * | 7/2002 |

* cited by examiner

*Primary Examiner* — Mitra Aryanpour
(74) *Attorney, Agent, or Firm* — Pearne & Gordon LLP

(57) ABSTRACT

A training apparatus for use on a training surface is disclosed. The training apparatus includes a sport-projectile stopping member and an elongated body substantially transverse to the sport-projectile stopping member. The elongated body has a first section, a second section, and a transition section between the first and second sections. A portion of the first section is positioned on the sport-projectile stopping member, and the first section is sized such that the sport-projection stopping member, the first section, the training surface and the transition section define an orifice through which a sport-projectile can pass through.

19 Claims, 6 Drawing Sheets

TRAINING APPARATUS

FIELD OF INVENTION

The present invention relates to a training apparatus and, more particularly, to a training apparatus for use on a training surface.

BACKGROUND OF THE INVENTION

Sports players require a range of skills that must be continually refined to become great players. Most, if not all, sports use a form of projectile such as a ball, puck or ring. Some sports restrict the handling of such projectile to hand (e.g. handball) or feet (e.g. soccer), while in other sports, the player must use a stick to manipulate the projectile (e.g. hockey, lacrosse or ringette). Moreover, in some sports, the game is played on an unfamiliar surface, which requires the player to learn an additional skill that is fundamental to the sport.

In sports where a stick is used to manipulate the projectile, in addition to the level of fitness and strength required by all athletes, the player must have good stick control. Most conventional training devices concentrate on these skills. For example, the training device in Murphy (U.S. Pat. No. 5,226,821) concentrates primarily on puck control for hockey players. Similarly, Maki (Canadian Patent No. 1,305,731) is for improving puck handling skills. Other conventional training devices concentrate on developing related skills such as shooting and/or passing (Witzke, U.S. Pat. No. 6,926,624; Hammett, U.S. Pat. No. 5,362,045; and, Cranston, U.S. Pat. No. 6,165,084).

While good stick control, shooting and passing skills are the basis for a good player, a great player possesses many more skills that must be developed and continually refined. Where the sport is played on an unfamiliar surface such as ice, there are many more variables in the equation to becoming a great player. For example, in the sport of hockey and ringette played on ice (both sports may be played on other surfaces), the player requires great skating skills, balance, agility and weight distribution in addition to all the other fundamental skills. Conventional training devices lack such training and thus, there is a need for a training device that develops a broader range of skills and physicality required by such players.

SUMMARY OF THE INVENTION

According to an aspect of the present invention, there is provided a training apparatus for use on a training surface. The apparatus includes a sport-projectile stopping member and an elongated body substantially transverse to the sport-projectile stopping member, the elongated body having a first section, a second section, and a transition section between the first and second sections, wherein a portion of the first section being positioned on the sport-projectile stopping member, and the first section being sized such that the sport-projection stopping member, the first section, the training surface and the transition section define an orifice through which a sport-projectile can pass through.

According to another aspect of the present invention, a kit for training a player on a training surface is provided. The kit includes a training apparatus and a supplementary training apparatus. The training apparatus includes a sport-projectile stopping member and an elongated body substantially transverse to the sport-projectile stopping member, the elongated body having a first section, a second section, and a transition section between the first and second sections, wherein a portion of the first section being positioned on the sport-projectile stopping member, and the first section being sized such that the sport-projection stopping member, the first section, the training surface and the transition section define an orifice through which a sport-projectile can pass through. The supplementary training apparatus includes an elongated body having a first and second ends, a top surface and a bottom surface, the elongated body defining an orifice between the first and second ends and the training surface for a sport-projectile to pass through.

BRIEF DESCRIPTION OF THE DRAWINGS

These and other features of the invention will become more apparent from the following description in which reference is made to the appended drawings wherein.

DETAILED DESCRIPTION

While the patent disclosure is described in conjunction with the specific embodiments, it will be understood that it is not intended to limit the patent disclosure to the described embodiments. On the contrary, it is intended to cover alternatives, modifications, and equivalents as may be included within the scope of the patent disclosure as defined by the appended claims. In the above description, numerous specific details are set forth in order to provide a thorough understanding of the present patent disclosure. The present patent disclosure may be practiced without some or all of these specific details.

In this specification and the appended claims, the singular forms "a," "an," and "the" include plural references unless the context clearly dictates otherwise. Unless defined otherwise, all technical and scientific terms used herein have the same meaning as commonly understood to one of ordinary skill in the art to which this invention belongs.

It will be further understood that the terms "comprises" or "comprising", or both when used in this specification, specify the presence of stated features, integers, steps, operations, elements, and/or components, but do not preclude the presence or addition of one or more other features, integers, steps, operations, elements, components, and/or groups thereof.

Training Apparatus

Figure 1:
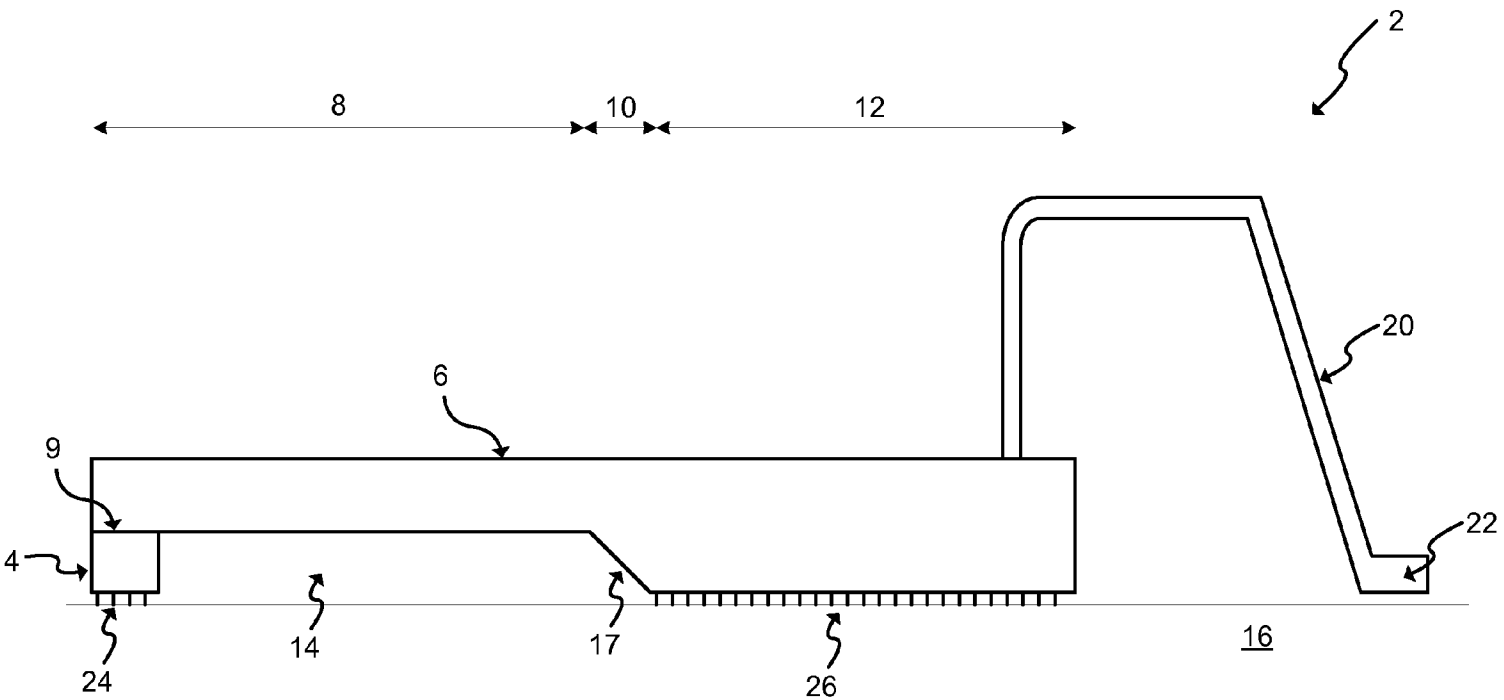
FIG. 1 shows a side view of an embodiment of the present invention.

Referring to FIG. 1, a side view of an embodiment of the present invention is shown. The training apparatus 2 comprises a sport-projectile stopping member 4 and an elongated body 6. The elongated body 6 has a first section 8, a second section 12, and a transition section 10 (i.e. the section of the elongated body 6 between the first section 8 and the second section 12), with a portion 9 of the first section 8 being positioned on the sport-projectile stopping member 4. In this embodiment, the elongated body 6 is substantially transverse to the sport-projectile stopping member 4 as best seen in FIG.

Figure 2:
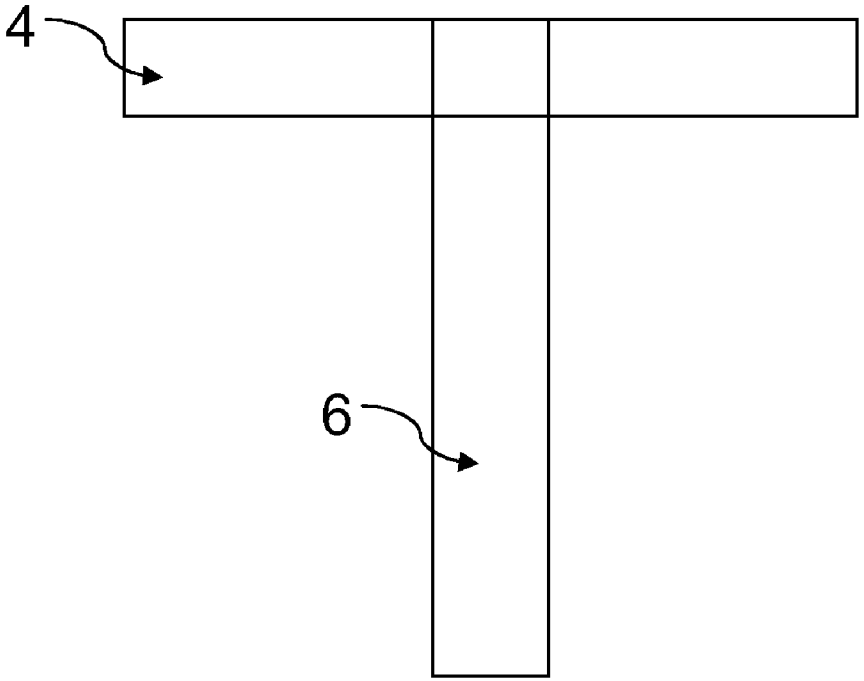
FIG. 2 shows a top view of an embodiment of the present invention.
Figure 3:
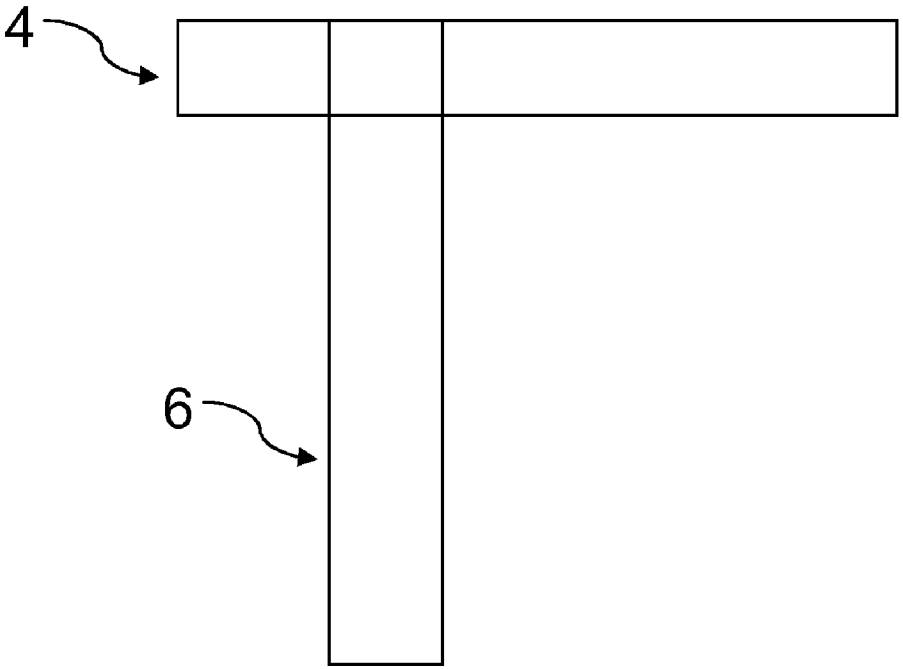
FIG. 3 shows a top view of another embodiment of the present invention.

2. Furthermore, as shown in FIG. 2, the elongated body 6 is positioned at the center of the sport-projectile stopping member 2. However, it is appreciated that other configurations are possible to vary the difficulty and type of the training exercise. For example, as shown in FIG. 3, the elongated body 6 may be positioned closer to one side of the sport-projectile stopping member 4.

Referring again to FIG. 1, the first section 8 of the elongated body 6 is thinner in cross-section than the second section 12 of the elongated body 6. With these proportions, an orifice 14 is defined by the sport-projectile stopping member 4, the first section 8, the transition section 10 and the training surface 16. During the training exercise, a player may be required to slide a sport-projectile (e.g. a puck, a ball or a ringette ring) through the orifice 14. Further, the transition section 10 has an angular edge 17. The angular edge 17 may be varied to change the size of the orifice 14. For example, the angular edge 17 may be vertical to maximize the size of the orifice 14, while the angular edge 17 may be further slanted to reduce the size of the orifice 14.

As it will be further described below, the combination of the orifice 14, the sport-projectile stopping member 4, and a series of training apparatus provide for a unique training experience.

Figure 5:
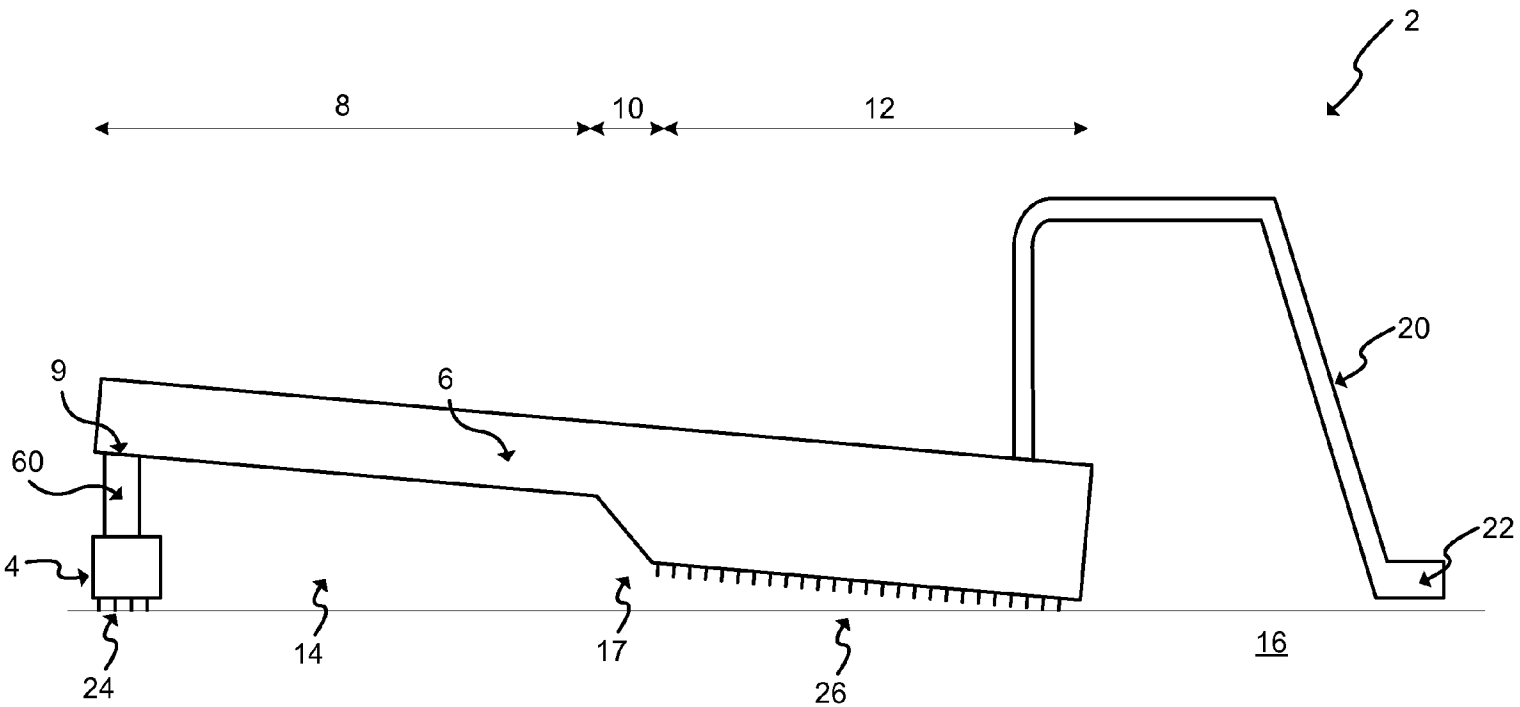
FIG. 5 shows a side view of a further embodiment of the present invention.
Figure 6:
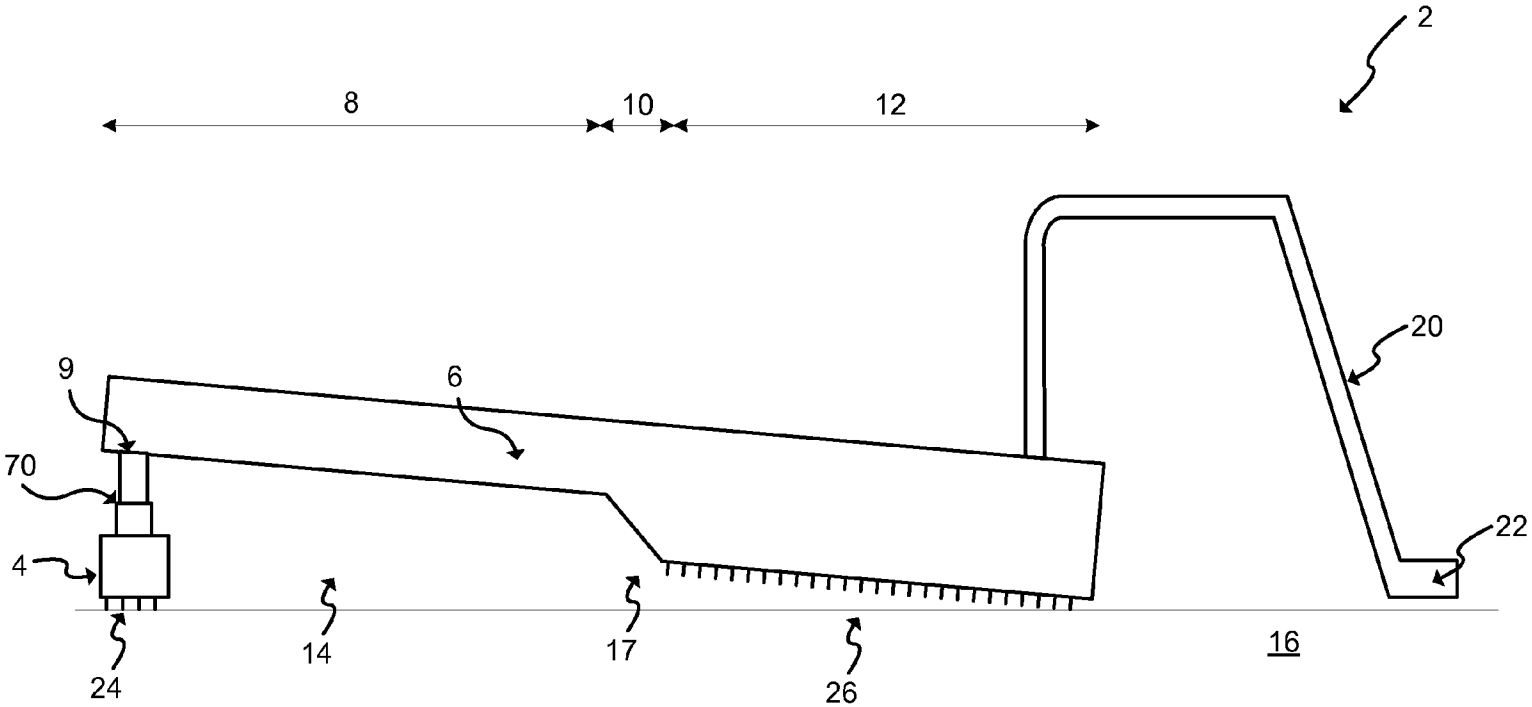
FIG. 6 shows a side view of a further embodiment of the present invention.

According to another embodiment of the present invention, an elevating member (60 of FIG. 5) may be included between the sport-projectile stopping member 4 and the portion 9 of the first section 8 of the elongated body 6. This allows the first section 8 of the elongated body 6 to be raised, thereby changing the size of the orifice 14. Furthermore, the slope of the elongated body 6 may be changed to increase the difficulty for the player jumping across the elongated body 6. The slope is the grade of the elongated body 6 with respect to the training surface 16. Alternatively, the elevating member may be a telescoping device (70 of FIG. 6) embedded within the sport-projectile stopping member 4 and coupled to portion 9 of the first section 8 of the elongated member 6 such that extension of the telescoping device raises the first section 8 of the elongated member 6. The elevating member may be formed from a strong and hard substance such as an appropriate plastic and/or metal.

According to a further embodiment of the present invention, a hockey stick resembling member 20 may be coupled to the second section 12 of the elongated body 6. In this embodiment, the hockey stick resembling member 20 is able to turn such that its blade portion 22 can be in several positions on the training surface 16, ranging from either side of the elongated body 6. Furthermore, the hockey stick resembling member 20 may be made to move independently through a range of positions by the addition of a mechanism for rotating (not shown) the hockey stick resembling member 20. For example, the mechanism may be an electric motor and a power source (not shown) that may be embedded within the elongated member 6 such that the hockey stick resembling member 20 may continuously move through the range of positions.

Where the training surface 16 is an ice surface, the underside of the sport-projectile stopping member 4 may include at least one spike 24 to reduce the sliding of the training apparatus 2. Additionally, the second section 12 may include at least one spike 26 to further help reduce the sliding of the training apparatus 2.

Figure 4:
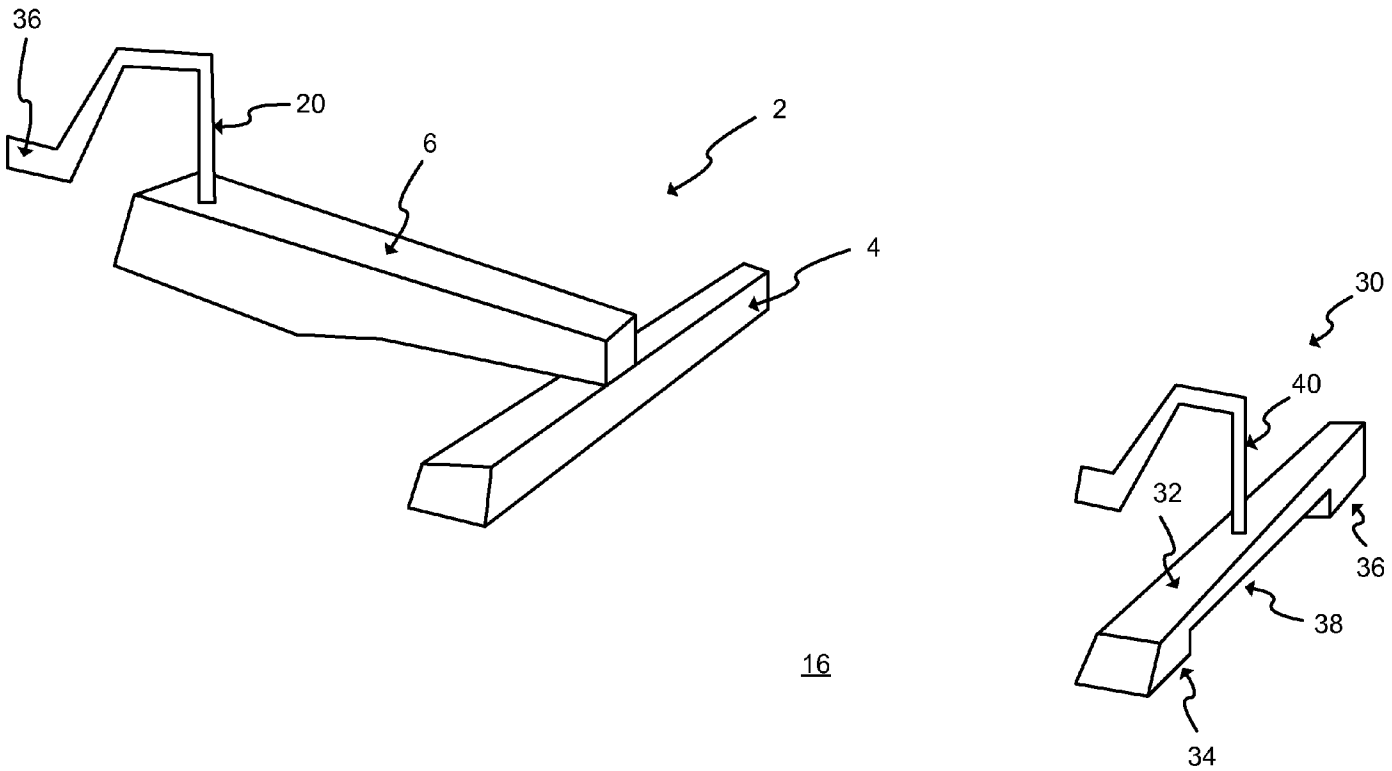
FIG. 4 is a perspective view of a set of training apparatus in accordance with a further embodiment of the present invention.

To further facilitate training of the player, a supplementary training apparatus 30 may be provided along with the training apparatus 2. The supplementary training apparatus 30, as shown in FIG. 4, includes an elongated body 32 having a first end 34 and a second end 36. Between the first and second ends 34, 36, an orifice 38 is provided. When the supplementary training apparatus 30 is placed on the training surface 16, the orifice 38 acts as a pass through for a sport-projectile (e.g. a puck, a ringette ring or a ball). To vary the difficulty of the training exercise, the elongate body 32 may include a first and second elevating member (not shown) on the underside of the first and second ends 34, 36 of the elongated body 32. In a further embodiment, a hockey stick resembling member 40 may be mounted on the elongated body 32. The hockey stick resembling member 40 may be rotatably mounted on the elongated body 32, at a position that is equidistant from the first and second ends 34, 36 of the elongated body 32. Furthermore, the hockey stick resembling member 40 may be made to move independently through a range of positions by the addition of a mechanism for rotating (not shown) the hockey stick resembling member 40. For example, the mechanism may be an electric motor and a power source (not shown) that may be embedded within the elongated member 32 such that the hockey stick resembling member 40 may continuously move through the range of positions.

Due to the nature of the use of the training apparatus 2 and the supplementary training apparatus 30, it may be advantageous for the training apparatus 2 and the supplementary training apparatus 30 to be made durable to withstand such things as skates sliding across the surfaces of both apparatus 2, 30 and players falling on both apparatus 2, 30. In accordance with an embodiment of the present invention, the sport-projectile stopping member 4 may be made by pouring a liquefied rubber and plastic mix into a mold. The mixture is then solidified into a component that is dense and durable to withstand the harsh training environment. The elongated body 6 of the training apparatus 2, the elongated body 32 of the supplementary training apparatus 30, and the hockey stick resembling member 20, 40 of the training apparatus 2 and supplementary training apparatus 40 may also be made using the same method.

Use of the Training Apparatus

In training, an embodiment of the training apparatus 2 and the supplementary training apparatus 30 may be used to improve agility, weight distribution and weight balancing for the player. The training exercise may incorporate a series of several training apparatus 2 and/or supplementary training apparatus 30 to vary the difficulty of the training exercise.

The following are specific uses of the training apparatus 2 and supplementary training apparatus 30 on ice surface. However, these specific uses only serve to illustrate example uses of the apparatus.

Crossovers

Crossover is a skill that is fundamental to a hockey or ringette player. Traditionally, players trained for crossover by weaving laterally across the skating surface through pylons or circles. However, by incorporating, for example, three or four of the training apparatus 2 in succession, it can provide a far more effective way of training for crossovers. In this way, the elongated body 6 of the training apparatus 2 is used as an obstacle for the player approaching the training apparatus 2 to jump over the elongated body 6. This requires the player to execute a strong push off the inside and outside edges of the skate to get over the elongated body 6, thereby helping players develop powerful pushes from both edges. This jumping exercise further helps the player correct his/her body positioning to achieve proper weight distribution and balance.

Moreover, the multiple training apparatus 2 may be arranged in various patterns to further add to the development of the player's edge control. The patterns may require the player to use deep edges and knee bends to initiate tight turns. Additionally, the player may be required to stick-handle a puck, a ball or a ringette ring and slide it through the orifice 14 without having the puck, ball or ring stopped by the sport-projectile stopping member 4. This further improves the agility and coordination of the player.

Backward Crossovers

While backward crossovers are important for all hockey and ringette players, it is critical for a defenseman. Defenseman must be able to crossover backwards while looking up the ice for an outlet pass, while maintaining puck or ringette ring control. A combination of one or several training apparatus 2 and supplementary training apparatus 30 may be used to train for backward crossovers.

As an example, the player may be required to skate forward toward a training apparatus 2. The player may then be required to change direction to jump over the training apparatus 2 backward while sliding the puck (or ringette ring or ball) through the orifice 14. This requires the player to execute and develop strong manoeuvrability skills, balance, weight distribution and agility. Depending on the subsequent skating pattern, the player may be required to quickly crossover and accelerate to the next training apparatus (i.e. second set of training apparatus 2 or supplementary training apparatus 30) to develop transitioning skills and "1st step" quickness.

Additionally, the training apparatus 2 and/or supplementary training apparatus 30 may include a hockey stick resembling member 20, 40 that is continually moving between a range of positions to mimic an opposing forechecker. This additional challenge may be incorporated to any type of training exercise as discussed herein.

Balance

To improve balance, the player may execute a "crossunder" while training with the training apparatus 2 and/or supplementary training apparatus 30. For example, as the player approaches forward to the training apparatus 2, he/she would have to execute a strong push off his/her skates to get over the training apparatus 2 with both feet. To get over the training apparatus 2, the player would have to swing the front foot (outside leg) over the training apparatus 2 that is behind his/her body. This requires the player to execute a lateral lean over the training apparatus 2 and land the outside skate on the skating surface, which becomes the "gripping edge" skate while the other skate becomes the "glide skate". In the same motion, the player would have to push off with the "gripping edge" and maintain the speed, puck (or ring or ball) control and balance to accelerate to the next apparatus in series on the skating surface. Balance and speed are lost if the player does not land smoothly on the "gripping skate". While the player is executing this manoeuvre, he/she would also have to lean over laterally on his/her inside skate edges, and simultaneously slide the puck (or ring or ball) through the orifice 14, without the puck (or ring or ball) getting stopped by the sport-projectile stopping member 4. While the player's upper body is leaning over the apparatus, the player improves balance and weight distribution. Furthermore, the lower body movement requires flexibility, lower body strength, and edge control.

Change of Direction

The ability to turn and change direction while maintaining speed and puck control is another desirable skill in hockey and ringette. To change direction quickly a player would have to develop balance, agility and manoeuvrability.

First, three or four iterations of an embodiment of the training apparatus 2 may be laid out in succession. The player may then be asked (by the trainer) to execute two or three crossovers over each of the training apparatus 2. The change of direction pattern requires the player to execute rapid leg movement and stick-handling through the successive first training apparatus 2 since he/she would have to change directions two or three times over the training apparatus 2. In addition to quickly turning and skating in the opposite direction, the player would have be able to rotate his/her upper body (waist through shoulders) through to the direction of travel. As the player trains this way with the training apparatus 2, he/she develops powerful cornering and transition skills.

This use of the training apparatus 2 also challenges the player to change from skating forward in one direction to skating backward in another direction and from skating backward in one direction to skating forward in another direction. To do this, the player would have to pivot forward and backward while maintaining puck control through the orifice 14 and through the hockey stick resembling members 20 of the training apparatus 2. All of the skating manoeuvres through the training apparatus 2 are executed on the "edges" of the skates, helping the player develop edge control. The sharper or tighter the turn, the deeper the player's edge will have to be. Furthermore, on the last change of direction over the training apparatus 2, the player would be required to accelerate to the next apparatus. This helps the player develop 1st step quickness.

Agility, Edge Control and Puck (or Ring or Ball) Control

Agility is the mark of an elite player and the following uses of the training apparatus 2 and supplementary training apparatus 30 may improve the agility, edge control and puck (or ring or ball) control of the player.

A training apparatus 2 and a supplementary training apparatus 30 are laid out one after another, with the supplementary training apparatus 30 being further down the skating path than the training apparatus 2. There may be multiples of both apparatus 2, 30 in succession. The player then starts approximately 25-feet from the training apparatus 2. As the player approaches the training apparatus 2 at full speed, he/she executes a "spin-around move". The "spin-around move" involves making a 360-degree rotation facing away from the training apparatus 2. As the player skates away from the training apparatus 2, he/she is required to slide the puck, ball or ring through the orifice 14 between his/her feet. After executing the "spin-around move", the player crosses over the training apparatus 2 and retrieves the puck, ball or ring on the other side of the training apparatus 2. The player then changes direction and cuts in between the training apparatus 2 and supplementary training apparatus 30. As the player skates between the two apparatus 2, 30, he/she slides the puck, ball or ring through the orifice 38 of the supplementary training apparatus 30. The player proceeds to retrieve the puck, ball or ring and sprints to the next set of apparatus in succession.

This skating pattern trains the hockey or ringette player how to beat an opponent by spinning and placing the puck on the other side of the opponent, where the player can retrieve it. The rules of hockey do not allow the opponent to "impede" the player while they do not have the puck, so as long as they can learn how to "create space" and place the puck around the opponent, they cannot be checked or held back. Training with the apparatus 2, 30 develops these skills because the player learns the feeling of spinning with control and gains confidence while passing the puck through the orifice 14, 38 as they go over the apparatus 2, 30. The player further develops short explosive skating movements that encourage improved cornering power and quickness.

The player develops good hand-eye co-ordination, multitasking abilities and agility by making accurate passes through the orifice 14, 38 of the apparatus 2, 30 in the same motion as through the feet of an opponent. He/she also develops a powerful stride because of the "push off" power required on the inside and outside edges to get over the apparatus 2, 30 and reach the puck that is waiting or sliding, all in the same motion. Repetition of this manoeuvre helps the player perform quicker and faster moves, as well as develop strong balance on skates.

Alternatively, or additionally, the apparatus 2, 30 may be used with skating patterns designed to specifically train edge control and puck control. This can be done by placing the next set of apparatus 2, 30 perpendicular to the previous set of apparatus 2, 30, used with the skating pattern just described. Once the player reaches the second set of apparatus 2, 30, he/she must balance on his/her inside edges while skating around the perimeter of the second set of apparatus 2, 30. He/she must also perform accurate stick-handling manoeuvres around the hockey stick resembling member 20, 40 and place the puck (or ring or ball) "under" or "over" the apparatus 2, 30, as directed by an instructor, while balancing on his/her edges around the second set of apparatus 2, 30. Once the player has completely circled the second set of apparatus 2, 30, he/she then accelerates with a strong push off the inside edge of the back skate, and outside edge of the inside skate, to go over the elongated body 6 of the training apparatus 2 of the second set of apparatus 2, 30. The player must also execute a strong lateral lean over the elongated body 6 for maximum power off the edges while he/she simultaneously slides the puck through the orifice 14 to the other side of the training apparatus 2 of the second set of apparatus 2, 30.

By using the apparatus 2, 30 in this way, the player develops agility, weight distribution, balance and quickness required to get over the apparatus 2, 30 and regain his/her stride as quickly as possible. The player also develops strong inside edge strength and co-ordination required to get around the hockey stick resembling members 20, 40 effectively. By skating over the elongated body 6 and landing to regain his/her stride as quickly as possible, the player trains balance, upper and lower body control, stability and puck control. This use of the apparatus 2, 30 is especially designed to help players improve in all of these areas, including "recovery". "Recovery" is a term used to describe the skill required by the player to land properly on the ice with control of the skate edges, body and feet. Good recovery allows the player not to lose speed and quickly transition into the next action. The player also learns that once they land after passing over the apparatus 2, 30, his/her blades must be in full contact with the ice, so that he/she has the necessary "edge grip" to push off again. He/she also improve his/her puck movement skills and stick-handling agility. Their confidence with the puck will subsequently improve.

Reaction Time

With all the training exercises described herein, the player is also able to develop quicker reaction time by attacking each apparatus 2, 30 at full speed. The training apparatus 2 and supplementary training apparatus 30 have limited space (i.e. the size of the orifice 14, 38) for the sport-projectile to pass through. From a distance, the orifice 14, 38 seems even smaller. Furthermore, the angular edge 17 of the training apparatus 2 further creates an impediment to the passage of the sport-projectile. Additionally, if the apparatus 2, 30 includes the hockey stick resembling member 20, 40, the player is presented with an additional challenge that he/she must adjust to as he/she approaches the apparatus 2, 30 at full speed. The addition of several apparatus 2, 30 in succession may also develop quick reaction time, especially if the successive apparatus 2, 30 are closely arranged.

One or more currently preferred embodiments have been described by way of example. It will be apparent to persons skilled in the art that a number of variations and modifications can be made without departing from the scope of the invention as defined in the claims.

What is claimed is:

1. A training apparatus for use on training surface, the apparatus comprising:

a sport-projectile stopping member for supporting a portion of the training apparatus on the training surface when in use comprising a first stopping surface capable of stopping a sport-projectile; and an elongated body substantially transverse to the first stopping surface of the sport-projectile stopping member, the elongated body comprising:

a first section proximate to a first end of the elongated body and coupled to the sport-projectile stopping member when in use;

a second end of the elongated body opposite the first end and supported on the training surface when in use;

a pass-under section, arranged between the first end and the second end, defined by a lower surface of the elongated body supported above the training surface by a height sufficient to allow the sport-projectile to pass between the training surface and the lower surface of the elongated body when in use;

a stopping section arranged between the pass-under section and the second end defined by the lower surface of the elongated body being in close proximity to the training surface to prevent the sport-projectile from passing between the training surface and the lower surface of the elongated body when in use; and a hockey stick resembling member mounted on the second section of the elongated body proximate to the second end.

2. The apparatus of claim 1, wherein the hockey stick resembling member is rotatably mounted on the second section of the elongated body.

3. The apparatus of claim 2, further comprising a mechanism for rotating the hockey stick resembling member.

4. The apparatus of claim 1, further comprising an elevating member between the sport-projectile stopping member and of the first section, wherein the elevating member is for raising the first section of the elongated body.

5. The apparatus of claim 1, further comprising an elevating member embedded within the sport-projectile stopping member and coupled to the first section, wherein the elevating member is a telescoping device.

6. The apparatus of claim 1, wherein the sport-projectile stopping member is made from a mixture of rubber and plastic.

7. The apparatus of claim 1, wherein the elongated body is made from a mixture of rubber and plastic.

8. The apparatus of claim 1, wherein the training surface is ice.

9. The apparatus of claim 8, wherein a portion of the sport-projectile stopping member resting on the training surface comprises at least one spike to reduce sliding of the sport-projectile stopping member.

10. The apparatus of claim 8, wherein a portion of the elongated body resting on the training surface comprises at least one spike to reduce sliding of the elongated body.

11. The apparatus of claim 1, wherein the lower surface of the elongated body at the pass-under section is supported above the training surface by a height sufficient to allow a sport projectile selected from the group consisting of a puck, a ball or a ringette ring to pass between the training surface and the lower surface of the obstacle member when in use.

12. A kit for training a player on a training surface, the kit comprising:

a training apparatus and comprising:

a sport-projectile stopping member for supporting a portion of the training apparatus on the training surface when in use comprising a first stopping surface capable of stopping a sport-projectile; and an elongated body substantially transverse to the first stopping surface of the sport-projectile stopping member, the elongated body comprising:

a first section proximate to a first end of the elongated body and coupled to the sport-projectile stopping member when in use;

a second end of the elongated body opposite the first end and supported on the training surface when in use;

a pass-under section, arranged between the first end and the second end, defined by a lower surface of the elongated body supported above the training surface by a height sufficient to allow the sport-projectile to pass between the training surface and the lower surface of the elongated body when in use;

a stopping section arranged between the pass-under section and the second end defined by the lower surface of the elongated body being in close proximity to the training surface to prevent the sport-projectile from passing between the training surface and the lower surface of the elongated body when in use; and a hockey stick resembling member mounted on the second section of the elongated body proximate to the second end; and a supplementary training apparatus separate from the training apparatus and comprising an elongated body having a first and second ends, a top surface and a bottom surface, and a pass-under section defined by a portion of the bottom surface of the supplementary training apparatus' elongated body supported above the training surface by a height sufficient to allow a sport-projectile to pass between the training surface and the portion of the bottom surface when in use.

13. The kit according to claim 12, wherein the supplementary training apparatus further comprises:

a hockey stick resembling member mounted on the elongated body between the first and second ends.

14. The kit according to claim 13, wherein the hockey stick resembling member of the supplementary training apparatus is rotatably mounted on the elongated body, equidistant from the first and second ends.

15. The kit according to claim 14, wherein the elongated body of the supplementary training apparatus further comprising a mechanism for rotating the hockey stick resembling member.

16. The kit according to claim 12, wherein the supplementary training apparatus is made from a mixture of rubber and plastic.

17. The kit according to claim 12, wherein the training surface is ice and a portion of the bottom surface of the elongated body of the supplementary training apparatus comprises at least one spike to reduce sliding on the ice.

18. A method of training a sports athlete comprising:

arranging a training apparatus on a sports surface, the training apparatus comprising:

a sport-projectile stopping member for supporting a portion of the training apparatus on the training surface when in use comprising a first stopping surface capable of stopping a sport-projectile; and an elongated body substantially transverse to the first stopping surface of the sport-projectile stopping member, the elongated body comprising:

a first section proximate to a first end of the elongated body and coupled to the sport-projectile stopping member when in use;

a second end of the elongated body opposite the first end and supported on the training surface when in use;

a pass-under section, arranged between the first end and the second end, defined by a lower surface of the elongated body supported above the training surface by a height sufficient to allow the sport-projectile to pass between the training surface and the lower surface of the elongated body when in use;

a stopping section arranged between the pass-under section and the second end defined by the lower surface of the elongated body being in close proximity to the training surface to prevent the sport-projectile from passing between the training surface and the lower surface of the elongated body when in use; and a hockey stick resembling member mounted on the second section of the elongated body proximate to the second end;

approaching, by the athlete, the training apparatus arranged on the sports surface; and attempting, by the athlete, to jump over the elongated body while passing the sport projectile through the pass-under section.

19. The method of claim 18, wherein the training surface is ice and the sports projectile is a puck or ringette ring.

* * * * *